US006978833B2

(12) United States Patent
Salamitou et al.

(10) Patent No.: US 6,978,833 B2
(45) Date of Patent: Dec. 27, 2005

(54) METHODS, APPARATUS, AND SYSTEMS FOR OBTAINING FORMATION INFORMATION UTILIZING SENSORS ATTACHED TO A CASING IN A WELLBORE

(75) Inventors: Philippe Salamitou, Mamaroneck, NY (US); Jacques Jundt, Bethel, CT (US); Robert Bailey, Danbury, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 156 days.

(21) Appl. No.: 10/452,447

(22) Filed: Jun. 2, 2003

(65) Prior Publication Data

US 2004/0238165 A1 Dec. 2, 2004

(51) Int. Cl.[7] ..... E21B 47/09

(52) U.S. Cl. ..... 166/255.1; 166/250.11; 166/254.2; 175/50

(58) Field of Search ..... 166/250.07, 250.11, 166/254.1, 254.2, 255.1; 175/48, 50; 340/853.9, 340/854.4, 854.6, 856.3; 73/152.02, 152.18, 73/152.51

(56) References Cited

U.S. PATENT DOCUMENTS 4,181,014 A * 1/1980 Zuvela et al. ..... 340/853.5
5,200,705 A * 4/1993 Clark et al. ..... 324/338
6,028,534 A 2/2000 Ciglenec et al. ..... 340/856.2
6,064,210 A * 5/2000 Sinclair ..... 324/369
6,070,662 A 6/2000 Ciglenec et al. ..... 166/254.1
6,234,257 B1 5/2001 Ciglenec et al. ..... 175/50
6,378,610 B2 4/2002 Rayssiguier et al. ..... 166/281
6,426,917 B1 7/2002 Tabanou et al. ..... 367/82
6,443,228 B1 9/2002 Aronstam et al. ..... 166/250.11
6,538,576 B1 3/2003 Schultz et al. ..... 340/859.6
6,684,952 B2 2/2004 Brockman et al. ..... 166/250.03
6,691,779 B1 2/2004 Sezginer et al. ..... 166/250.01
6,693,553 B1 2/2004 Tabanou et al. ..... 340/853.1
2002/0195247 A1 12/2002 Ciglenec et al. ..... 166/250.11

* cited by examiner

*Primary Examiner*—Zakiya Walker
(74) *Attorney, Agent, or Firm*—Jody Lynn DeStefanis; David P. Gordon; Dale Gaudier

(57) ABSTRACT

Improved methods, apparatus, and systems for obtaining information regarding a formation, a casing, or fluid within the casing utilize an interrogator and one or more sensing devices attached to a casing in a wellbore. The interrogator, which is located and typically movable inside the wellbore, is effectively a toroidal transformer which includes an elongate conducting body surrounded by a core of high magnetic permeability material and carrying a winding. The sensing device, which is positioned and fixed in an opening cut in the casing, includes a housing, a sensor with associated electronic circuitry and an electrode. The electrode is insulated from the casing by an insulator, and the housing of the sensing device is typically adapted to provide a hydraulic seal with the opening in the casing. The interrogator and sensing device communicate in a wireless manner.

32 Claims, 3 Drawing Sheets

METHODS, APPARATUS, AND SYSTEMS FOR OBTAINING FORMATION INFORMATION UTILIZING SENSORS ATTACHED TO A CASING IN A WELLBORE

This application is related to co-owned U.S. Ser. No. 10/163,784 to R. Ciglenec, et al. entitled "Well-Bore Sensor Apparatus and Method", and to co-owned U.S. Ser. No. 09/428,936 to A. Sezginer, et al. entitled "Wellbore Antennae System and Method", and to co-owned U.S. Pat. No. 6,426,91 and to co-owned U.S. Ser. No. 09/382,534 to R. Ciglenec et al. entitled "Reservoir Management System and Method", and to co-owned U.S. Pat. No. 6,028,534, and to co-owned U.S. Pat. No. 6,234,257, and to U.S. Pat. No. 6,070,662, all of which are hereby incorporated by reference herein in their entireties.

BACKGROUND OF THE INVENTION

1. Field of the Invention

The present invention relates to methods, apparatus, and systems for obtaining information regarding a geological formation or a well passing through a geological formation. The present invention more particularly relates to methods, apparatus, and systems for exchanging information and power between an interrogating tool located in a cased borehole and sensors attached to the casing.

2. State of the Art

The extraction of oil and natural gas from a geological formation is usually accomplished by drilling boreholes through the subsurface formations in order to reach hydrocarbon-bearing zones, and then using production techniques for bringing the hydrocarbon to the surface through the drilled boreholes. To prevent the boreholes from collapsing, boreholes are often equipped with steel tubes called casings or liners which are cemented to the borehole wall. Once they are put in place, casings and liners preclude direct access to the formation, and therefore impede or prevent the measurement of important properties of the formation, such as fluid pressure and resistivity. For this reason, the logging of wellbores is routinely performed before the casing is set in place.

In order to optimize the depletion of the reservoir, it is highly desirable to monitor the temperature, pressure and other formation parameters at different depths in the well, on a permanent basis, over most of the life of the well. Valuable information regarding the integrity of the wellbore can be gained from continuously monitoring parameters such as well inclination and casing thickness. A common approach to such monitoring consists of attaching sensors to the outside of the casing, interconnecting the sensors via cables to provide telemetry and power from the formation surface, and cementing the sensors and cables in place. A description of such a system is provided in U.S. Pat. No. 6,378,610 to Rayssiguier et al. Such a system has numerous apparent drawbacks such as complicating the installation of the casing and the impossibility of replacing failed components. Another monitoring system is disclosed in U.S. patent application Ser. No. 2001/0035288 to Brockman et al. which discloses means for exchanging information and power through the casing wall via inductive couplers. These couplers, however, require extensive modification of the casing and are not suitable for an installation in situ. In previously incorporated U.S. Pat. No. 6,070,662 Ciglenec et al., means are disclosed for communicating with a sensor implanted in the formation, but this arrangement requires that the sensor be put in place prior to the installation of the casing. U.S. Pat. No. 6,443,228 to Aronstam et al. describes means of exchanging information and power between devices in the borehole fluid and devices implanted in the wellbore wall, but does not consider the problems introduced by the presence of a casing or a liner.

SUMMARY OF THE INVENTION

It is therefore an object of the invention to provide apparatus, methods, and systems for obtaining information regarding a geological formation or a well passing through a geologic formation.

It is another object of the invention to provide methods, apparatus, and systems for exchanging information and power between an interrogating tool located in a cased borehole and sensors attached to the casing.

It is a further object of the invention to provide apparatus, methods, and systems for communicating information between an interrogating tool in a borehole and a sensor attached to a casing without using cables and without significantly altering the casing.

In accord with the objects of the invention an interrogating device and a sensing device are provided. The interrogating device which is located and which is movable inside the wellbore is effectively a toroidal transformer which includes an elongate conducting body surrounded by a core of high magnetic permeability material and carrying a winding. The sensing device which is positioned and fixed in an opening cut in the casing includes a housing, a sensor with associated electronic circuitry and an electrode. The electrode is insulated from the casing by an insulator, and the housing of the sensing device is preferably adapted to provide a hydraulic seal with the opening in the casing.

Alternating current circulated in the winding of the toroidal transformer induces a magnetic flux in the transformer core which causes a voltage difference to be established on opposed ends of the conducting body. The voltage difference, in turn, causes current to flow in at least a loop which includes the conducting body of the transformer, the borehole fluid, the sensing device, and the casing. Current collected by the electrode may be rectified inside the sensing device to provide power to the electronic circuitry and to the sensor. By modulating the current circulated in the winding of the transformer of the interrogating device, information may be passed from the transformer to the sensing device which picks up and demodulates the signal. Likewise, the sensing device may send information to the interrogating device by modulating a voltage difference applied between the electrode of the sensing device and the casing. The current induced in the winding of the interrogating device may be demodulated in order to determine the information being transmitted.

The system of the invention preferably includes a plurality of sensing devices located along the length of the casing, and at least one interrogating device which is moved through the wellbore. The method of the invention preferably includes locating a plurality of sensing devices along the length of the casing, moving the interrogating device through the casing, and using the interrogating device to signal the sensing device, and the sensing device to obtain information regarding the formation and provide that information to the interrogating device in a wireless manner.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
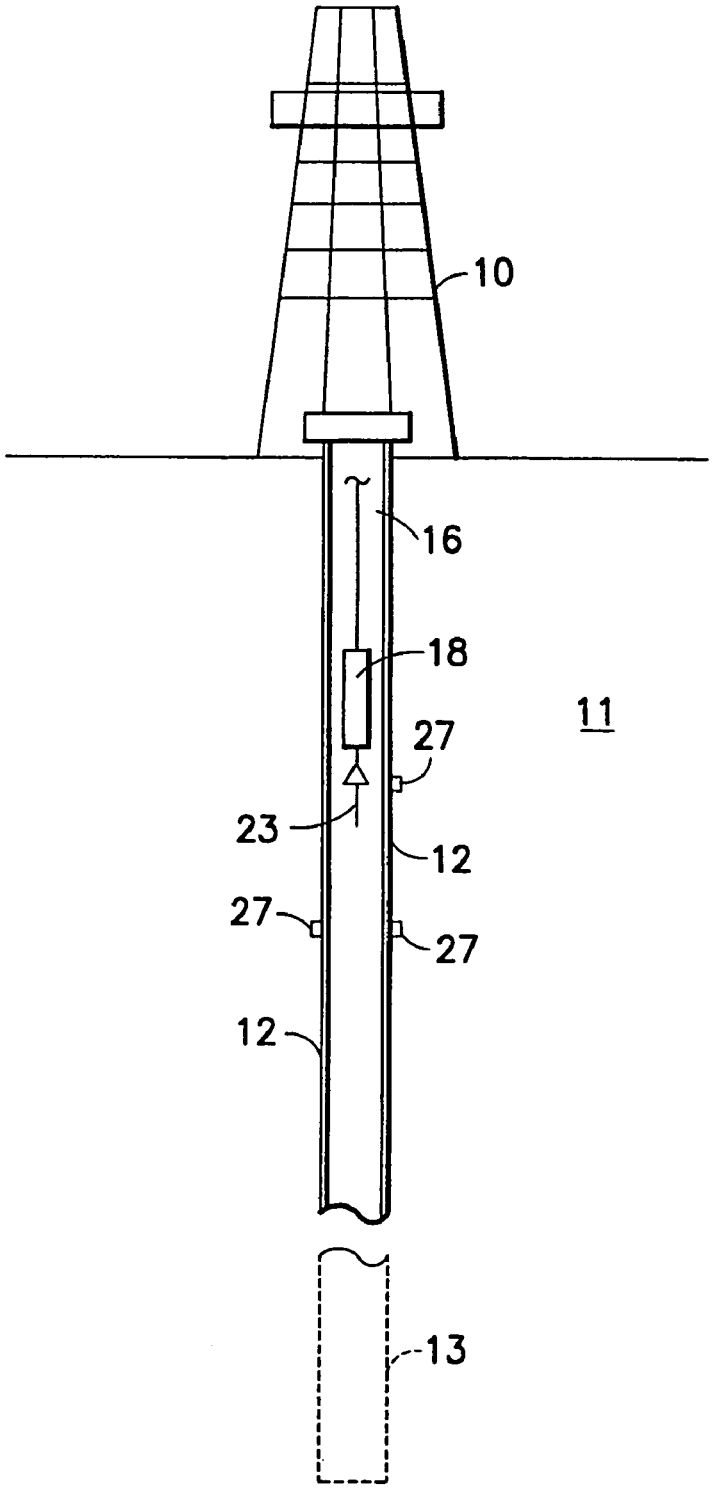
FIG. 1 is a schematic diagram showing the system of the invention in a wellbore of a formation.

Turning to FIG. 1, a highly schematic drawing of a typical oil production facility is seen. A rig 10 is shown atop an earth formation 11. The earth formation is traversed by a wellbore 13 having a casing 12 extending at least partially therein. The casing 12 contains a fluid 16 which is typically a conductive borehole fluid. Extending from the rig 10 or from a winch (not shown) into the casing is a tool 18.

The system of the invention 20 is shown in FIG. 1 as including an interrogator or interrogating device 23 which is coupled to or part of tool 18 and a sensing device 27. The interrogator 23 is preferably movable inside the casing 12 of the wellbore, whereas the sensing device 27 is preferably fixed in the casing 12 as described below. According to the invention, the system of the invention 20 includes at least one interrogator 23 and at least one sensing device 27. More preferably, the system of the invention 20 includes at least one interrogator 23 and multiple sensing devices 27 which are located along the length of the casing.

Figure 2:
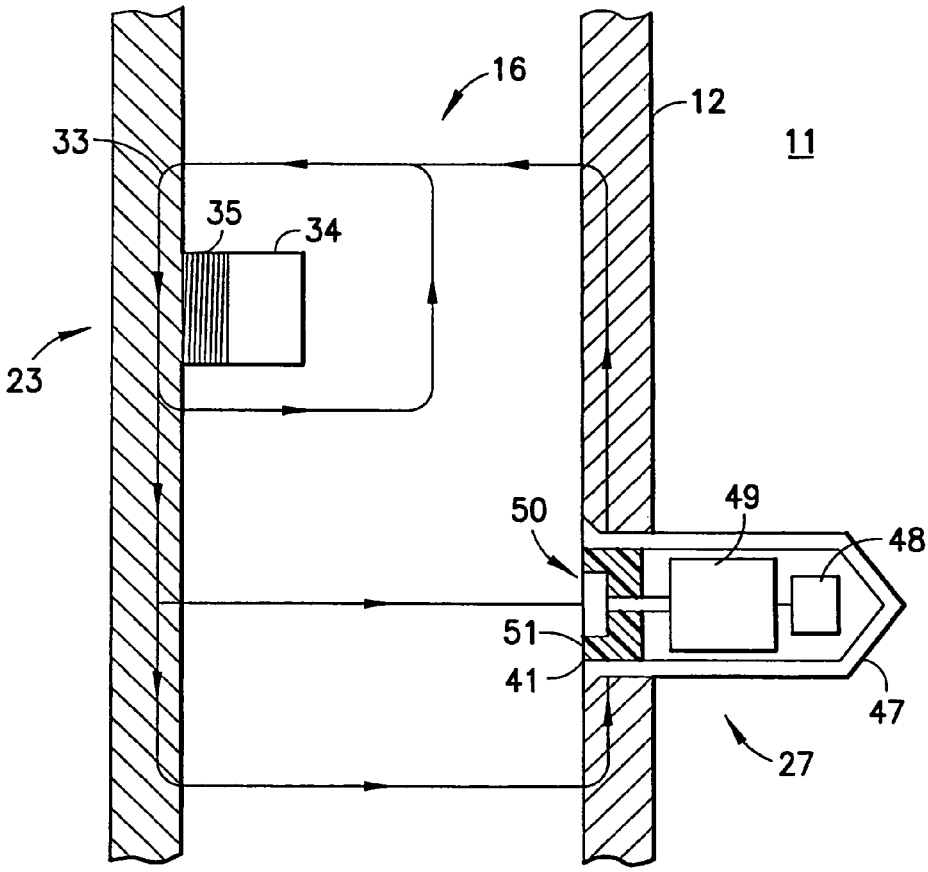
FIG. 2 is a partial cross-sectional schematic diagram showing the system of the invention and illustrating current flow with an interrogator in an interrogation mode and a sensing device in a receiving mode.
Figure 3:
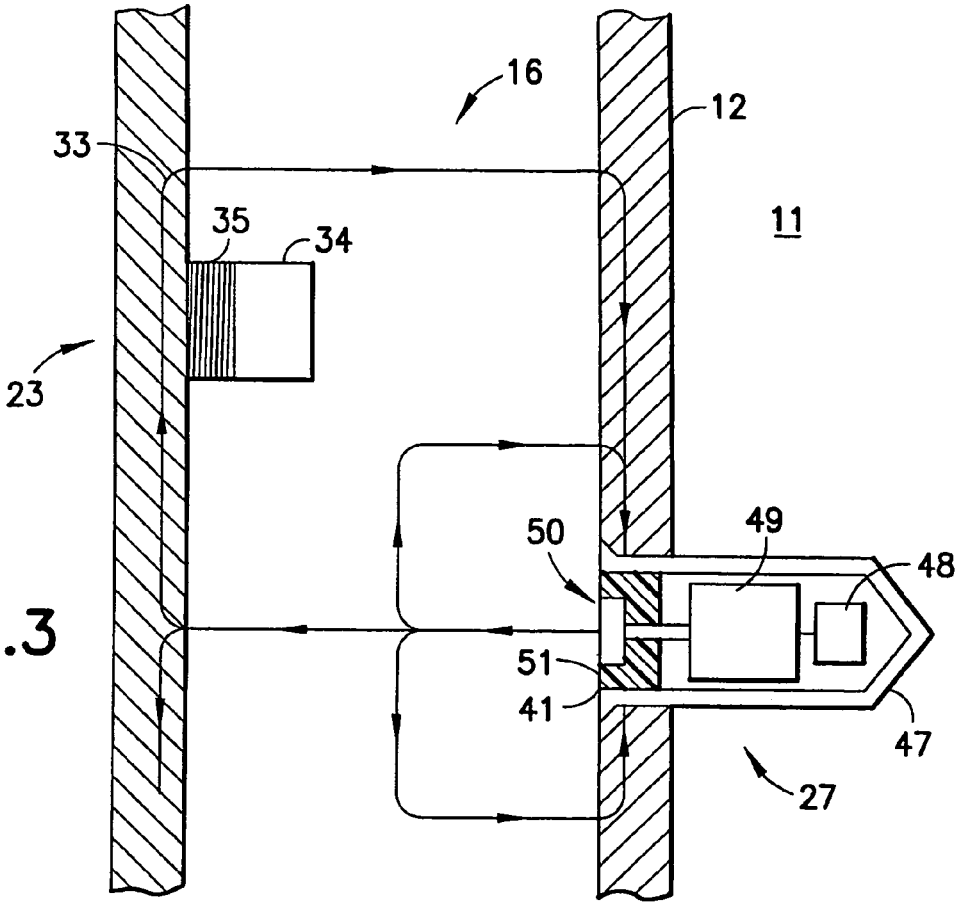
FIG. 3 is a partial schematic cross-sectional diagram showing the system of the invention and illustrating current flow with the sensing device in a sending mode and the interrogator in a receiving mode.

As seen in FIGS. 2 and 3, the interrogating device 23 is effectively a toroidal transformer which includes an elongate conducting body (rod or pipe) 33 surrounded by a core of high magnetic permeability material 34 which carries a conductive winding 35. The magnetic core 34 may be fixed in a groove (not shown) formed on the conducting body 33 and potted in an insulating material for mechanical and chemical protection. The winding 35 is preferably insulated from the conducting body 33. The interrogating device 23 is preferably implemented as a tool conveyed via wireline, slick line, or coiled tubing. Thus, the elongate conducting body 33 is typically between one foot and several feet long, although it may be longer or shorter if desired. Alternatively, the interrogating device may be embedded in a drill pipe, drill collar, production tubing, or other permanently or temporarily installed component of a wellbore completion. Regardless, the interrogating device 23 is preferably adapted to communicate with surface equipment (not shown) via any of many telemetry schemes known in the art, and may use electric conductors, optical fibers, mud column pulsing, or other media to accomplish the same. Alternatively, the interrogating device 23 may include data storage means such as local memory (not shown) for storing data retrieved from sensors. The content of the memory may be unloaded when the interrogator 23 is retrieved to the surface of the formation 10.

The sensing device 27 of the invention is shown positioned and fixed in an opening 41 cut in the casing 12, and includes a housing 47, one or more sensors 48 (one shown) with associated electronic circuitry 49 and one or more electrodes 50 (one shown). The housing 47 may be an assembly of several parts made of the same or different materials, including, but not limited to metals, ceramics, and elastomers. Depending upon the type of sensor(s) 48 included in the sensing device 27, the housing 47 may include one or more holes (not shown) which allows formation or wellbore fluids to come into contact with the sensor(s) 48. The electrode 50 is insulated from the casing by an insulator 51 which may be an integral part of the sensing device 27. The housing 47, electrode 50, and the insulator 51 of the sensing device 27 are preferably adapted to provide a hydraulic seal with the opening 41 in the casing 12. The electrode 50 and insulator 51 are preferably flush with an inner surface of the casing 12 thereby allowing unimpeded motion of equipment within the wellbore.

The sensor 48 and electronic circuitry 49 preferably perform multiple functions. In particular, each sensor 48 preferably senses one or more properties of the formation 10 surrounding the casing (e.g., pressure, temperature, resistivity fluid constituents, fluid properties, etc.), or one or more properties of the casing 12 itself (e.g., inclination, mechanical stress, etc.). The sensing may be continuous, at predefined times, or only when commanded by the interrogator 23. If sensing is continuous or at predefined times, the sensing device 27 may store information it obtains in memory (which may be part of the associated circuitry 49) until the sensing device is interrogated by the interrogator. When interrogated, the circuitry 49 associated with the sensor 48 preferably functions to electronically transmit (via the electrode 50) information obtained by the sensor 48 to the interrogator 23 as will be described hereinafter. The sensing device 27 may, if desired, incorporate a unique code to unambiguously identify itself to the interrogator 23.

According to one aspect of the invention, the interrogator 23 either includes means for generating an alternating current in the winding 35, or is coupled to such an alternating current generator. When alternating current is circulated in the winding 35 of the toroidal transformer, a magnetic flux is induced in the transformer core 34 which causes a voltage difference to be established on opposed ends (i.e., above and below the core 34) of the conducting body 33. The voltage difference, in turn, causes current to flow such that, as seen in FIG. 2, three categories of current loops are generated. A first loop includes the conducting body 33 and the conductive fluid 16 inside the casing 12 which conducts current back to the conducting body 33. A second loop includes the conducting body 33, the conductive fluid 16 inside the casing 12, and the casing 12. In the second loop, current returns back to the conducting body 33 via fluid 16. A third loop which is of most interest for purposes of the invention is a loop which includes the conducting body of the transformer 33, the fluid 16, and the electrode 50 of the sensing device 27. By modulating the current circulated in the winding 35 of the transformer of the interrogating device 23 according to any of many schemes known to those skilled in the art, information may be passed from the interrogator 23 to the sensing device 27 which picks up and demodulates the signal. The return path for the current received by electrode 50 is either from the sensing device 37 via the formation 11, the casing 12, and the fluid 16 and back to the conducting body 33, and/or via a dedicated grounding conductor (not shown) from the circuitry 49 to the housing 47, to the casing 12, and via the fluid 16 back to the conducting body 33.

According to one aspect of the invention, the current collected by the electrode 50 may be rectified by circuitry 49 in order to provide power to the circuitry 49 and the sensor(s) 48. If the current collected by the electrode 50 is too weak to power the electronic circuitry 49 and sensor(s) 48 directly, the current may be accumulated over a suitable period of time in an energy storage component such as a capacitor, a supercapacitor or a battery. The electronic circuitry 49 may wake up and become active when the accumulated charge is sufficient for its correct operation.

According to another aspect of the invention, the sensing device 27 may send information to the interrogator 23 by modulating, in any of many known manners, a voltage difference (generated by the electronic circuitry 49) which is applied by the sensing device 27 between the electrode 50 of the sensing device 27 and the casing 12. The resulting categories of current loops are shown in FIG. 3, with a first loop including the electrode 50, the fluid 16, the casing 12, and back to the sensing device 27 (via the housing 47, etc.), and a second loop including the electrode 50, the fluid 16, the conducting body 33 of the interrogator, and back through the fluid 16, the casing 12 and the sensing device 27. The current carried by the conducting body 33 causes a magnetic flux in the magnetic core 34, which in turn induces a current in the winding 35 of the interrogating device 23. The current in the winding may be sensed and demodulated in order to determine the information being transmitted.

It should be appreciated by those skilled in the art that with the sensing device 27 fixed in the casing 12 and having an electrode 50 insulated relative to the casing, and with the interrogator 23 as described, when the magnetic core 34 of the interrogator is directly facing the electrode 50, no signal generated by the sensing device 27 will be detected by the interrogator 23; i.e., the telemetry transfer function exhibits a sharp null. Thus, the sensing device 27 may be used as a marker for the purpose of defining or identifying a place of particular interest along the well, as the location of the sensing device can be located very accurately by moving the interrogator 23 past the sensing device 27 and noting the location of a sharp null signal followed by a phase reversal.

Figure 4:
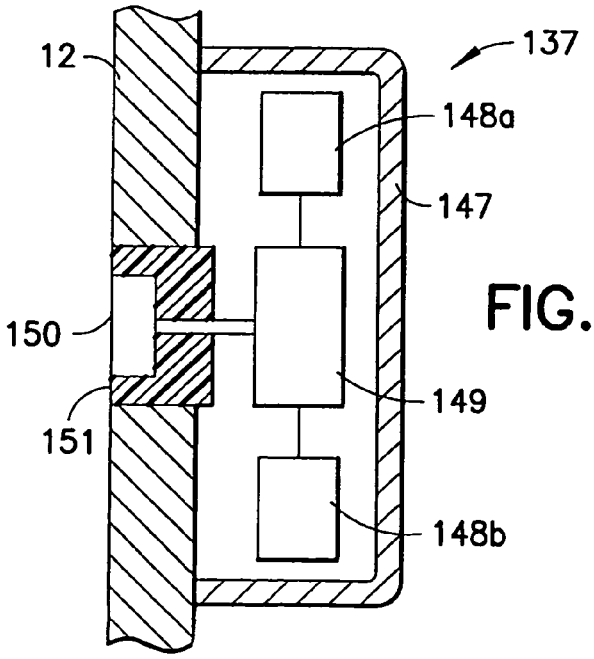
FIG. 4 is a partial schematic cross-sectional diagram showing another embodiment of a sensing device according to the invention.

Turning now to FIG. 4, a second embodiment of a sensing device 137 of the invention is shown. The sensing device 137 includes a housing 147, two sensors 148*a*, 148*b*, electronic circuitry 149, an electrode 150, and an insulator 151 for insulating the electrode relative to a casing 12 and for providing a hydraulic seal between the casing 12 and the inside of the sensing device 137. As seen in FIG. 4, the housing 147 of sensing device 137 is mounted to the outer surface of the casing 12, while the electrode 150 and insulator 151 are flush with the inside surface of the casing 12. With the provided geometry, it will be appreciated that the sensing device 137 is preferably attached to the casing 12 prior to the installation of the casing in the wellbore. It will also be appreciated that sensing device 137 may function in the same manner as sensing device 27 of FIGS. 2 and 3.

The system of the invention preferably includes a plurality of sensing devices 27 or 137 and at least one interrogating device 23. The sesning device may be located along the length of the casting 12 and/or at different azimuths of the casting. The interrrogating device is preferably moved through the wellbore.

According to a first method of the invention, a plurality of sensing devices are located along the length of the casing, the interrogating device is moved through the casing, the interrogating device is used to signal the sensing device, and the sensing device obtains information regarding the formation and provides that information to the interrogating device in a wireless manner.

According to another method of the invention, at least one sensing device is located along the length of the casing at a desired location along the wellbore, the interrogating device is moved through the casing, and a change in the wireless signal provided by the sensing device to the interrogating device is used to precisely locate the desired location along the wellbore. More particularly, by moving the interrogator past the sensing device and noting the location of a sharp null signal followed by a phase reversal the location of interest (i.e., the location where the sensing device is located) may be identified precisely.

There have been described and illustrated herein embodiments of systems, methods and apparatus for obtaining formation information utilizing sensors located behind a casing in a wellbore. While particular embodiments of the invention have been described, it is not intended that the invention be limited thereto, as it is intended that the invention be as broad in scope as the art will allow and that the specification be read likewise. Thus, while the invention was described with reference to a particular interrogating device and particular sensing devices, other interrogating devices and sensing devices could be utilized. For example, an interrogating device might utilize a plurality of toroids in order to focus the current flowing in the borehole fluid. In particular, magnetic cores may be used as chokes to constrain the generated current over a particular section(s) of the conducting body. Also, instead of using a toroidal transformer, an electrode pair may be used on the surface of the conducting body in order to generate a voltage difference and resulting current. Further, with respect to the sensing devices, it will be appreciated that various other types of sensing devices such as disclosed in previously incorporated U.S. Ser. No. 10/163,784 may be utilized provided that the sensing device be in electrical contact with the casing and have an electrode in contact with the fluid inside the casing and electrically insulated from the casing. In addition to casings and liners, the sensing apparatus may be deployed in any type of metal wellbore device, such as sand screens. While preferably deployed in a metal wellbore device containing conductive fluid, the system can also operate in non-conductive fluid by increasing the frequency of operation by a factor of approximately one hundred . It will therefore be appreciated by those skilled in the art that yet other modifications could be made to the provided invention without deviating from its spirit and scope as claimed.

We claim:

1. A sensing apparatus which is affixed to a metal wellbore device containing fluid, the metal wellbore device having a wall and located in an earth formation traversed by the wellbore device, said sensing apparatus comprising:

a) a housing in electrical contact with the metal wellbore device;

b) an electrode in electrical contact with the fluid;

c) insulation between said electrode and said housing;

d) a sensor which senses a condition of at least one of the earth formation, the wellbore device, and the fluid, and e) circuitry coupled to said sensor and to said electrode, said circuitry generating a wireless signal related to a determination of said condition sensed by said sensor by generating a signal having a voltage difference between said electrode and the wellbore device, wherein said sensing apparatus extends through the wall of the metal wellbore device.

2. A sensing apparatus according to claim 1, wherein:

said housing, said electrode, and said insulation provide a hydraulic seal between the fluid and the formation.

3. A sensing apparatus according to claim 1, wherein:

said electrode and said insulation provide a hydraulic seal between the fluid and the formation.

4. A sensing apparatus according to claim 1, wherein:

said housing, said electrode, and said insulation are adapted to be flush with a surface of the metal wellbore device.

5. A sensing apparatus according to claim 1, wherein:

said circuitry applies an alternating voltage difference between said electrode and one of said housing and the metal wellbore device.

6. A sensing apparatus according to claim 1, wherein:

said circuitry includes a rectifier which supplies power to said sensor.

7. A sensing apparatus according to claim 1, wherein:

said sensor senses at least one of temperature, pressure, resistivity, fluid constituents, and fluid properties of the formation.

8. A sensing apparatus according to claim 1, further comprising:

a second sensor which senses a condition of at least one of the earth formation and the wellbore device, said second sensor coupled to said circuitry.

9. A sensing apparatus according to claim 1, wherein:

said housing is mounted to an outer surface of the wellbore device.

10. A system for obtaining information about an earth formation traversed by a wellbore having a metal wellbore device containing conductive fluid therein, said system including:

a) an interrogator movable in said metal wellbore device; and b) at least one sensing apparatus which is affixed to the metal wellbore device and which extends into the formation, said at least one sensing apparatus including an electrode in electrical contact with the fluid, a housing in electrical contact with the metal wellbore device, insulation between said electrode and said housing, a sensor which senses a condition of at least one of the earth formation, the wellbore device, and the fluid, and circuitry coupled to said sensor and to said electrode, said circuitry generating a wireless signal related to a determination of said condition sensed by said sensor by generating a signal having a voltage difference between said electrode and the wellbore completion device, wherein said interrogator is adapted to detect an indication of said signal.

11. A system according to claim 10, wherein:

said interrogator comprises an elongate conducting body, a core of high magnetic permeability material which surrounds a portion of said elongate conducting body, and a conductive winding wound about said high magnetic permeability material.

12. A system according to claim 11, wherein:

said magnetic core is fixed to said elongate conducting body.

13. A system according to claim 10, wherein:

said interrogator comprises a pair of interrogator electrodes which generate a voltage difference therebetween.

14. A system according to claim 10, wherein:

said interrogator is adapted to generate a current signal which is forced to flow in the conductive fluid, and said electrode is adapted to sense said current signal.

15. A system according to claim 10, wherein:

said housing, said electrode, and said insulation provide a hydraulic seal between the fluid and the formation.

16. A system according to claim 10, wherein:

said electrode and said insulation provide a hydraulic seal between the fluid and the formation.

17. A system according to claim 10, wherein:

said circuitry applies an alternating voltage difference between said electrode and one of said housing and the metal wellbore device.

18. A system according to claim 10, wherein:

said sensor senses at least one of temperature, pressure, resistivity, fluid constituents, and fluid properties of the formation.

19. A system according to claim 10, wherein:

said at least one sensing apparatus comprises a plurality of substantially identical sensing apparatus spaced along the metal wellbore device.

20. A system according to claim 19, wherein:

said plurality of substantially identical sensing apparatus are spaced both longitudinally and azimuthally along the metal wellbore device.

21. A method for transmitting information in an earth formation traversed by a wellbore having a metal wellbore device containing fluid therein, the method comprising:

a) affixing at least one sensing apparatus to the metal wellbore device such that the sensing apparatus extends into the formation, said at least one sensing apparatus including an electrode in electrical contact with the fluid, a housing in electrical contact with the metal wellbore device, insulation between said electrode and said housing, a sensor which senses a condition of at least one of the earth formation, the wellbore device, and the fluid, and circuitry coupled to said sensor and to said electrode;

b) sensing with said sensing apparatus a condition of at least one of the earth formation, the wellbore device, and the fluid;

c) locating an interrogator device in the vicinity of the sensing apparatus;

d) generating a wireless signal related to a determination of said condition sensed by said sensor by generating a signal having a voltage difference between said electrode and the wellbore device;

e) receiving said wireless signal at said interrogator device; and f) causing an indication of said wireless signal to be obtained uphole.

22. A method according to claim 21, wherein:

said affixing comprises affixing a plurality of substantially identical sensing apparatus spaced along the metal wellbore device.

23. A method according to claim 22, wherein:

said plurality of substantially identical sensing apparatus are affixed both longitudinally and azimuthally along the metal wellbore device.

24. A method according to claim 21, wherein:

said locating comprises moving said interrogator device within the metal wellbore device to different locations in the vicinities of said plurality of sensing apparatus.

25. A method according to claim 21, wherein:

said locating comprises moving said interrogator device within the metal wellbore device.

26. A method according to claim 21, wherein:

said interrogator device comprises an elongate conducting body, a core of high magnetic permeability material which surrounds a portion of said elongate conducting body, and a conductive winding wound about said high magnetic permeability material.

27. A method according to claim 21, wherein:

said interrogator device comprises a pair of interrogator electrodes which generate a voltage difference therebetween.

28. A method according to claim 21, further comprising:

generating a current signal with said interrogator device which is forced to flow in the conductive fluid, and sensing said current signal at said electrode of the sensing device.

29. A method according to claim 28, wherein:

said current signal is a wakeup signal for said sensing device.

30. A method for identifying a place of interest in an earth formation traversed by a wellbore having a metal wellbore device containing fluid therein, the method comprising:

a) affixing a location indicator to the metal wellbore device at the place of interest, said at least one location indicator including an electrode in electrical contact with the fluid, a housing in electrical contact with the metal wellbore device, insulation between said electrode and said housing, and circuitry coupled to said electrode;

b) generating a current signal with said location indicator;

c) moving a detecting device through the metal wellbore device and past said location indicator, said detecting device adapted to receive said current signal;

d) identifying the place of interest by finding a sharp null in said current signal.

31. A method of interrogating a sensing apparatus which is affixed to a metal wellbore device, the method comprising:

a) locating an interrogator device in the vicinity of the sensing apparatus;

b) receiving a wireless signal produced by the sensing apparatus at said interrogator device; and c) causing an indication of said wireless signal to be obtained uphole.

32. A method of transmitting information in an earth formation traversed by a wellbore having a metal wellbore device containing fluid therein, the metal wellbore device also having at least one sensing apparatus affixed to the metal wellbore device and extending into the formation, the at least one sensing apparatus including an electrode in electrical contact with the fluid, a housing in electrical contact with the metal wellbore device, insulation between the electrode and the housing, a sensor which senses a condition of at least one of the earth formation, the wellbore device, and the fluid, and circuitry coupled to the sensor and to the electrode, the method comprising:

a) locating an interrogator device in the vicinity of the sensing apparatus;

b) receiving a wireless signal produced by the sensing apparatus and relating to said condition at said interrogator device; and c) causing an indication of said wireless signal to be obtained uphole.

* * * * *